US006648142B1

(12) United States Patent
Hugenholtz et al.

(10) Patent No.: US 6,648,142 B1
(45) Date of Patent: Nov. 18, 2003

(54) DEVICE FOR STORING AND TRANSPORTING INDIVIDUAL LOADS

(75) Inventors: Roland Patrick Henri Hugenholtz, Sint-Martens-Latem (BE); Werner Philomena Theophiel Camps, Antwerpen (BE)

(73) Assignee: Conteyor Multibag Systems N.V., Merelbeke (BE)

( * ) Notice: Subject to any disclaimer, the term of this patent is extended or adjusted under 35 U.S.C. 154(b) by 0 days.

(21) Appl. No.: 09/743,730

(22) PCT Filed: Jul. 7, 1999

(86) PCT No.: PCT/EP99/04754

§ 371 (c)(1),
(2), (4) Date: Mar. 28, 2001

(87) PCT Pub. No.: WO00/03925

PCT Pub. Date: Jan. 27, 2000

(30) Foreign Application Priority Data

Jul. 16, 1998 (DE) ..... 19831967
Jan. 28, 1999 (DE) ..... 19903297

(51) Int. Cl.[7] ..... B65D 85/00
(52) U.S. Cl. ..... 206/425; 206/214
(58) Field of Search ..... 206/429, 449, 206/214, 555, 564

(56) References Cited

U.S. PATENT DOCUMENTS 215,248 A * 5/1879 Shipman ..... 206/425
4,262,838 A * 4/1981 Mackenzie ..... 229/72
4,602,734 A * 7/1986 Thompson ..... 229/67.4
4,817,861 A * 4/1989 Henrikson ..... 229/122
4,958,728 A * 9/1990 Effendi ..... 206/425
5,593,086 A * 1/1997 Ho ..... 229/67.3
5,630,509 A * 5/1997 Su ..... 206/425
5,725,119 A * 3/1998 Bradford et al. ..... 220/6
5,815,903 A * 10/1998 Foster et al. ..... 29/401.1
5,819,922 A * 10/1998 Martin, Jr. ..... 206/214
6,164,440 A 12/2000 Van Bree
6,431,357 B1 * 8/2002 Su ..... 206/425

* cited by examiner

*Primary Examiner*—Shian Luong
(74) *Attorney, Agent, or Firm*—Michael L. Dunn

(57) ABSTRACT

The present invention concerns an apparatus for storing and transporting piece goods, at least comprising a bottom portion (1), side or frame portions (2, 3) arranged thereon and a plurality of substantially flexible pockets (4, 5, 14) which can be received on the bottom portion (1) and/or between the frame portions (2, 3). In order to provide an apparatus having the above-specified features in which either the compartments or pockets or the apparatus overall can be collapsed or varied relatively simply, that is to say with a low level of technical complication and expenditure and involving a small amount of time and can be set up ready with the pockets again, it is proposed in accordance with the invention that the pockets overall or at least group-wise can be put into a closely collapsed or folded condition and in that condition can be put into the housing formed from the bottom portion and the side or frame portions or can be replaced by other pockets.

17 Claims, 4 Drawing Sheets

DEVICE FOR STORING AND TRANSPORTING INDIVIDUAL LOADS

Figure 1:
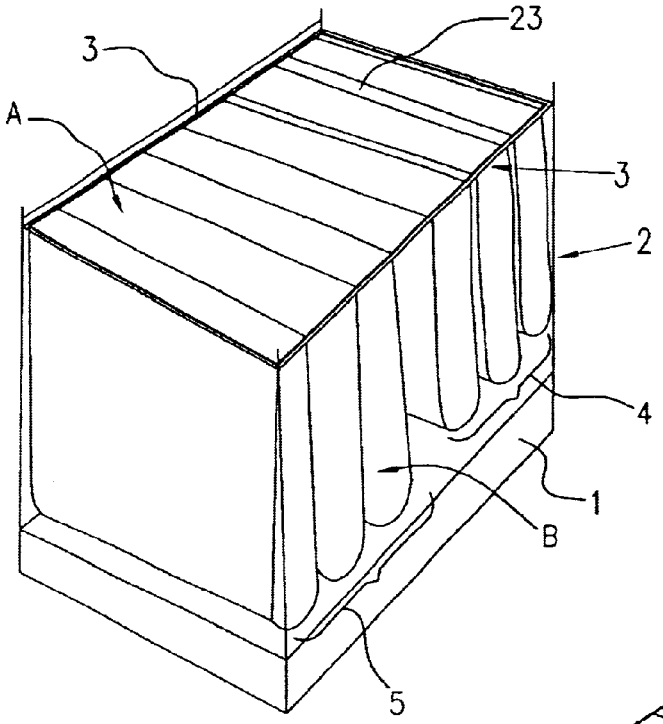

The invention concerns an apparatus for storing and transporting piece goods, comprising a bottom portion, side or frame portions arranged thereon and a plurality of substantially flexible pockets which are at least partially connected together in groups and which can be at least partially fixed to the frame portions and/or the bottom portion.

Such an apparatus is known from German patent applications Nos P 41 38 507 and 195 49 166. In those known apparatuses, pockets formed from a flexible web material are suspended in a frame on bars which extend through loops at the upper ends of the pockets and which in turn are guided on upper longitudinal frame members of the frame.

In the apparatus known from P 41 38 507 for loading and unloading purposes the pockets are successively individually removed from the guide means of the upper longitudinal frame members and emptied. After all transverse bars carrying the pockets have been pulled out of the guide means of the upper longitudinal frame members of the frame, rigid connections between the individual frame portions can be released so that the frame portions can then be collapsed to the bottom portion to form a more compact unit. However, the pockets have to be transported separately therefrom.

The apparatus known from DE 195 49 166 has an unloading device from which the pockets which have been taken out of the upper frame portion and emptied can be further conveyed into a stowage space which is arranged beneath the upper frame portions and which can also be provided on a carriage, which can be pulled out, of the frame.

Apparatuses of that kind have at the present time their main area of application in the sector of automobile manufacture, in which respect such apparatuses are used to transport the most widely varying individual parts of motor vehicles, in particular also bodywork parts such as doors, door claddings and the like, in such a way that on the one hand they can be quickly and easily packed and removed from the apparatus and on the other hand they are well protected from any damage or normal transportation conditions, in which respect there is also advantageously no packaging material whatsoever that has to be thrown away or disposed of. It will be noted that in order to save on transportation costs it would be desirable if corresponding apparatuses, as soon as they have been completely unloaded, can be collapsed together into as compact a configuration as possible, in which respect however the operations involved in erecting and collapsing apparatuses of that kind should not demand an excessive amount of time.

In the case of above-mentioned P 41 38 507 re-erection of the frame and in particular re-introduction of the individual bars into the upper frame guides is a relatively time-consuming procedure and the fact that the frame and the pockets are under some circumstances collapsed separately from each other and as a result are possibly also transported separately in different receptacles or trucks can result in further complications, in particular if individual parts of the various apparatuses are of different dimensions so that only given pockets and frames fit together.

In comparison with that state of the art, the object of the present invention is to provide an apparatus having the features set forth in the opening part of this specification, in which the compartments or pockets or however the apparatus overall can be collapsed or varied relatively simply, that is to say involving a low level of technical complication and expenditure and involving a small amount of time, and can be erected in the finished condition again with the pockets.

That object is attained in that the pockets overall or at least group-wise can be put into a closely collapsed or folded condition and in that condition can be introduced into the housing formed from the bottom portion and the side or frame portions or can be replaced by other pockets.

In the context of the present invention the term "housing" is to be interpreted very broadly and therefore includes everything which is suitable for receiving and holding pockets which can be collapsed or folded together. The housing can therefore be a box consisting of closed walls, but equally also a frame which is open towards all sides (including towards the bottom), possibly with the required strut or bracing means, as well as all conceivable hybrid forms comprising open and closed "housings". In this sense also the terms "frame portions" and "side portions" are interchangeable.

Preferred alternative configurations of the apparatus according to the invention are distinguished in that a plurality of pockets are formed from interconnected material webs and in the unfolded condition define a compartmentalisation organisation of the housing formed from the bottom portion and the side portions, in which respect optionally a plurality of different pockets or compartment divisions can be fitted into a housing.

A particularly preferred embodiment provides that the frame portions are arranged pivotably or releasably on the bottom portion and that the pockets which are collapsed or folded together and the frame portions can be received on the bottom portion or in the bottom portion in such a way that neither the pockets nor the frame portions project beyond the base area of the bottom portion.

The apparatus according to the invention is preferably of such a configuration that the bottom portion can receive all individual portions which go to make up the entire transportation apparatus, that is to say the bottom portion is in the form of a hollow box or frame into which all individual parts can be fitted or at least laid thereon. If the parts are only laid thereon at the top, it will be appreciated that it is desirable if they are fixed or can be fixed to the bottom portion in that condition of being disposed thereon. In specific terms therefore both the pockets in the folded-together condition and also the side portions which can possibly be removed or folded in can be received in or on the bottom portion. For that purpose it is only necessary to suitably select the dimensions of the apparatus, in other words the side portions and the pockets for example should be no higher or in the folded-over or removed or collapsed condition no wider and also no longer than the bottom portion is wide or long respectively.

In this respect therefore no frame portions should project beyond the limits of the base area defined by the bottom portion as correspondingly projecting parts cause problems in terms of transportation, can damage other articles or can also result in injury to people.

It is particularly desirable in this respect if the pockets, in order to be collapsed, do not have to be released from any frame portions on which they are suspended, but if they can be placed jointly with those frame portions for example in a box-shaped bottom portion. In this respect those frame portions, that is to say in particular longitudinal frame members, on which are suspended transverse frame members extending transversely through loops on the pockets, must be released from the other frame portions, and the frame members must obviously also fit into the bottom portion.

The pockets can be open at the top and the ends and they can be joined together for example in one piece or however they can form separate, U-shaped loops so that damping material in the form of foamed plates or the like can also be respectively arranged therebetween.

In a particular embodiment of the present invention the pockets at least partially comprise a sufficiently stiff material so that although on the one hand they are foldable, on the other hand they can be set up in a free-standing fashion at least in an unfolded and opened condition. For example the individual pockets which are essentially formed from web material extending in a U-shaped could have at their ends sufficiently stiff foldable strips of material or those end material webs can be made from side portions which are sufficiently stiff but nonetheless foldable or provided with one or more fold lines. It is particularly preferable in that respect if a plurality of pockets are oriented in succession and are of an interconnected configuration, in which case the respective ends thereof jointly form an interconnected concertina configuration.

The pockets can also be folded together and pulled apart in a concertina-like fashion, in which case strut means, hooks or the like should desirably be provided on the bottom portion and/or the frame, so that by means thereof the pockets can be held in their completely unfolded condition on the apparatus.

The first and/or the last in this series of interconnected pockets can desirably also have at their respective end walls a material web which can be laid in the manner of a cover onto the upwardly open sides of the pockets so that the pockets are closed at the top.

Furthermore, a preferred embodiment of the present invention is one in which a strap encompasses a group of pockets or all pockets of a corresponding apparatus on at least three sides, wherein the strap is preferably guided through loops (33) along the two end surfaces of the pockets. The central part of the strap which comes into engagement with the front surface or the rearward surface of the first and last pockets respectively can have a reinforcement in the form of a more or less stiff inlay portion or portion disposed thereon, or that central part of the strap can also be replaced by a bar, strip or the like so that the two remaining ends of the strap engage the ends of that bar which extends transversely over a pocket and the individual pockets can thus be drawn together to form a compact unit. It will be appreciated that the strap may also have suitable tightening or connecting elements in order to hold the pockets in the condition of being drawn together.

The pockets which are correspondingly connected together in a concertina-like fashion and which can be set up in a substantially free-standing configuration do not have to be suspended individually but they can stand freely on the bottom portion or however they only have to be fixed to the bottom portion or the frame portions at a few points, for example in the region of the first and last pockets. Thos connections are quick and easy to release and can be equally quickly and easily restored so that the pockets can be very easily folded together and fitted into or onto the bottom portion, whereupon the frame portions which of course do not necessarily have to be provided can then also be folded in so that thereafter the apparatus forms a very compact, substantially cuboidal unit.

Figure 2:
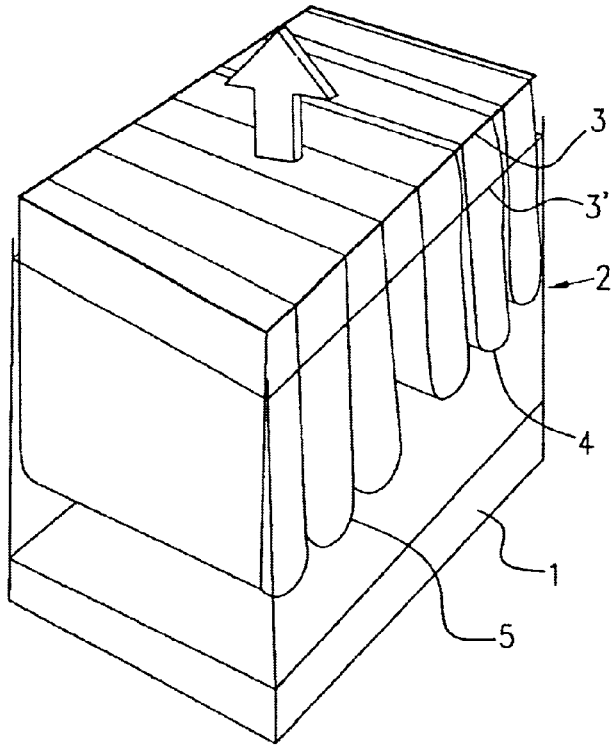
Figure 3:
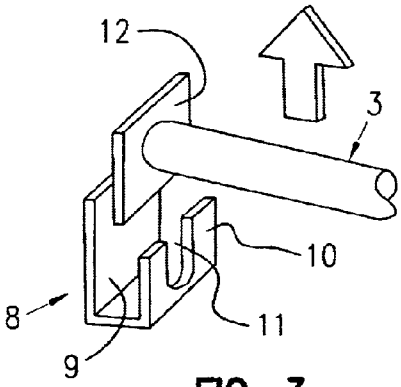
Figure 4:
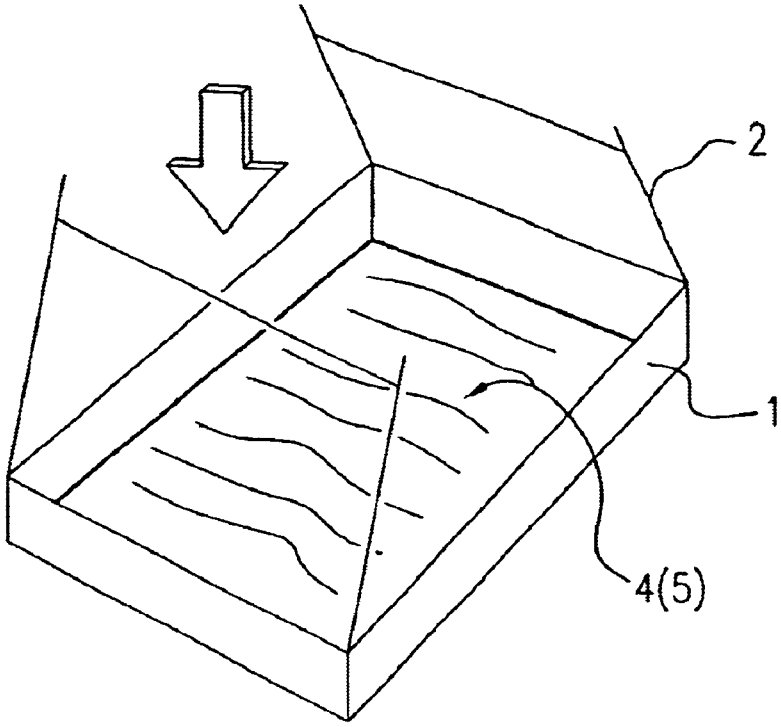
Figure 5:
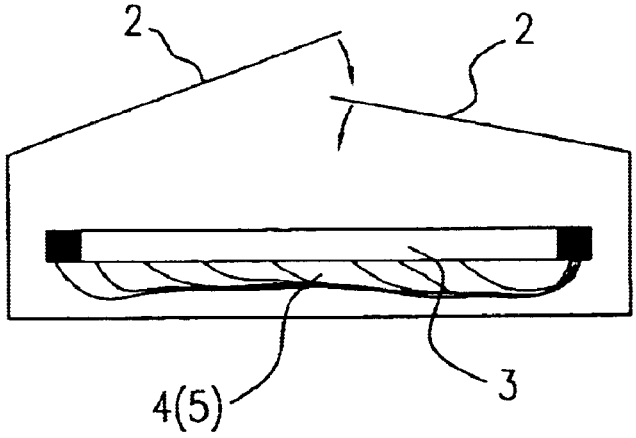
Figure 6:
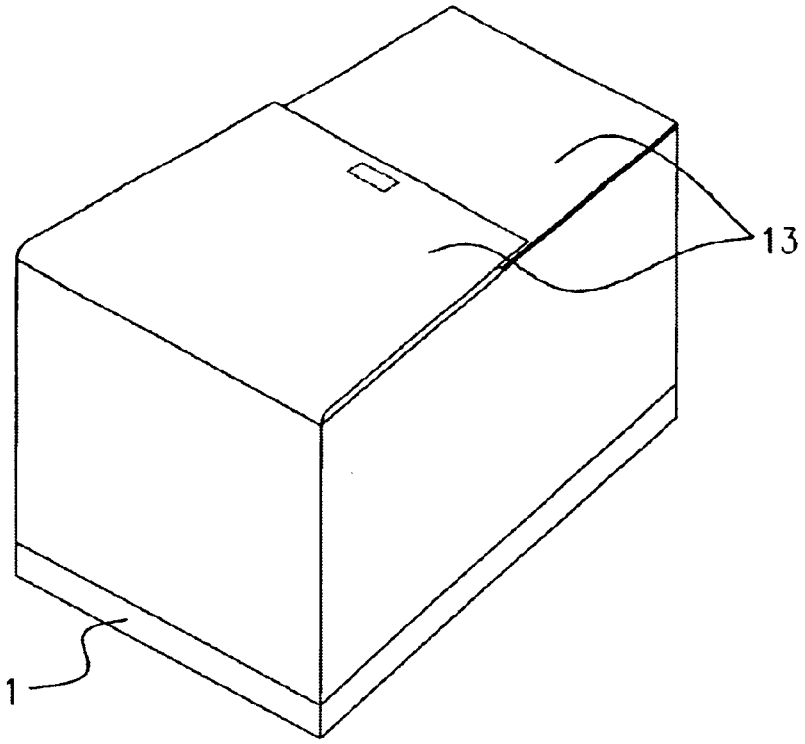
Figure 7:
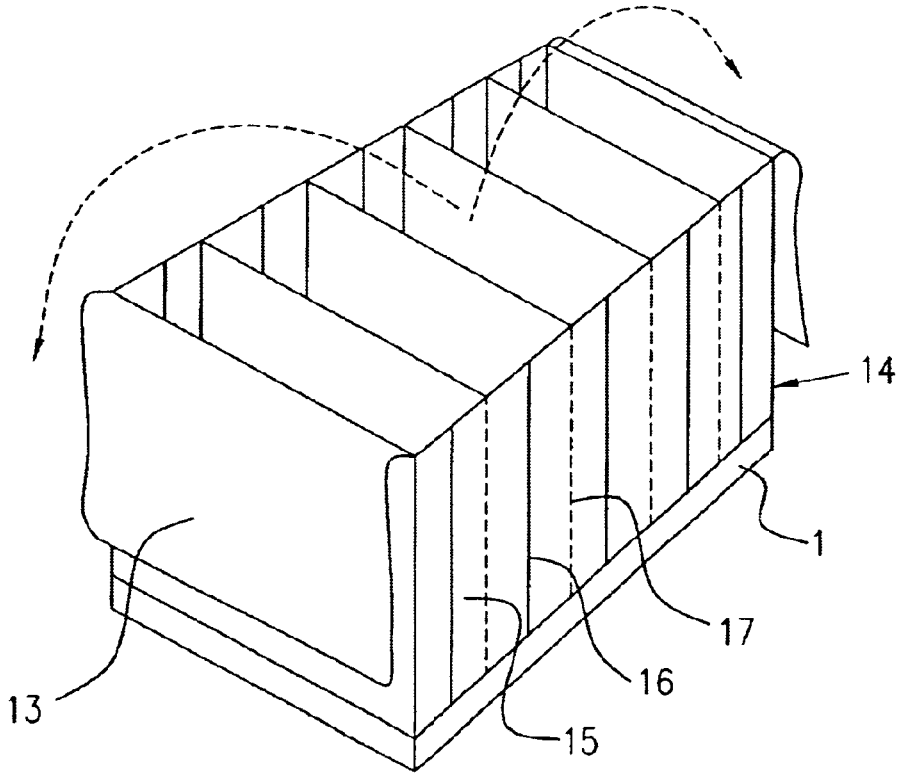
Figure 8:
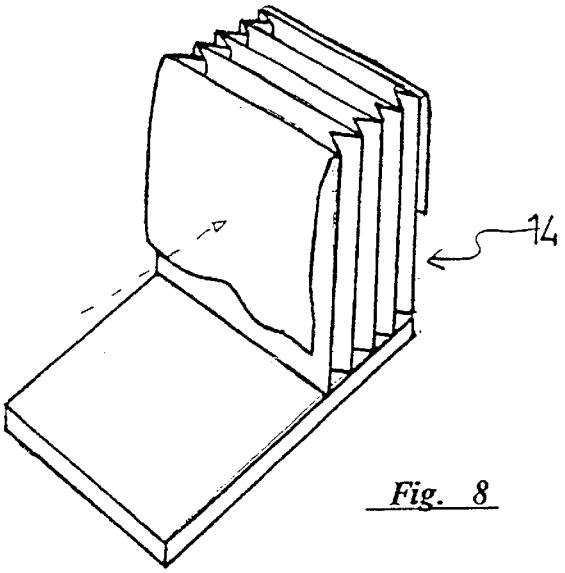
Figure 10:
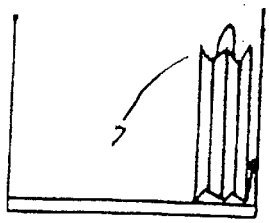
Figure 11:
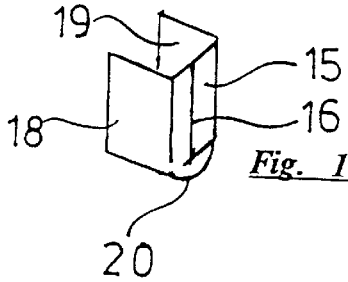
Figure 12:
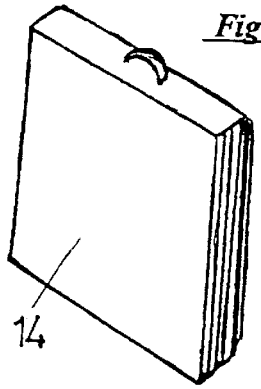
Figure 9:
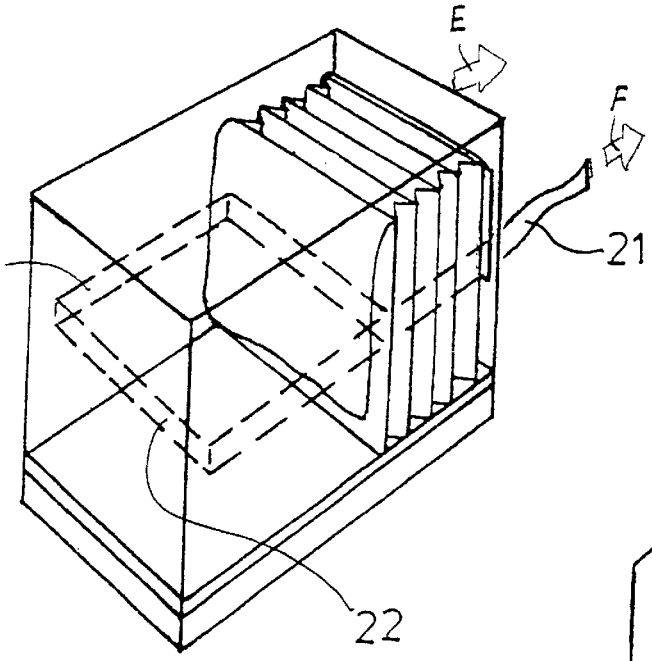
Figure 13:
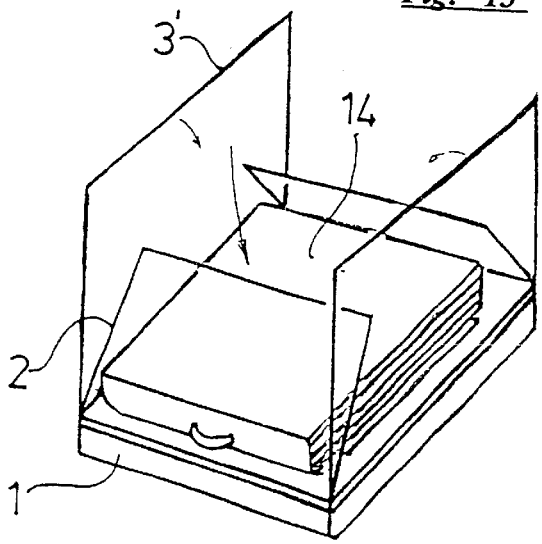

Further advantages, features and possible uses of the present invention will be apparent from the following description of a preferred embodiment and the accompanying drawings in which:

FIG. 1 shows a bottom portion with a frame erected thereon and pockets suspended therefrom, FIG. 2 shows the bottom portion and the frame of FIG. 1 but with the pockets removed from their suspended condition and lifted upwardly, and with associated frame portions, FIG. 3 shows details of the suspension of frame portions 3 which carry the pockets, FIG. 4 shows the apparatus with pockets fitted into the bottom portion, FIG. 5 is a view in longitudinal section through the apparatus in the condition shown in FIG. 4, FIG. 6 is an outside view of a further embodiment of the invention in an opened-out unfolded condition, FIG. 7 is a view of the apparatus in FIG. 6 in the opened condition, FIG. 8 shows the embodiment of FIGS. 6 and 7 in a partially folded-together condition, FIG. 9 shows an alternative to the embodiments of FIGS. 6 through 8, in which a strap is used for pulling the pockets together, FIG. 10 diagrammatically shows a side view of the embodiments of FIGS. 6 through 9, in a partially folded-together condition, FIG. 11 is a detail view of the lower side or corner region of the individual pockets, FIG. 12 shows the pockets alone in a collapsed condition, and FIG. 13 shows the pockets which are put into or onto the bottom portion and the foldable frame portions of the apparatus.

The apparatus shown in FIG. 1 comprises a cuboidal, upwardly open box 1 which forms the bottom portion of the apparatus, and frame portions 2 which are erected thereon and which can be still better seen from FIG. 2 and FIGS. 4 and 5, wherein frame portions 3 which essentially consist of rods or bars extending in the longitudinal direction connect together in the upper region the frame portions 2 which are pivotably mounted to the two ends of the bottom portion 1.

In the example shown in FIG. 1 two different groups of pockets 4 and 5 are suspended on the upper bars or frame portions 3. The group of pockets 4 comprises three substantially U-shaped pockets consisting of a more or less loosely downwardly hanging web of material. In the present example the three pockets are completely separate from each other but they can also be connected to each other in the upper region at the transition from one pocket to the next and in particular the three pockets can be formed by a continuous one-piece web of material. At any event it is possible for a foam plate 23 also to be inserted between the walls of adjacent pockets. In contrast the pockets 5 are also connected together in one piece in their lower region, that is to say only the first pocket of the pockets 5 comprises a U-shaped web of material while the further pockets comprise webs of material which are J-shaped in side view and which are connected in the lower region to the respectively next adjacent web of material on that side. The individual pockets 5 are therefore only separated by a single wall of a web of material so that corresponding foam plates cannot be inserted here. It will be appreciated however that any damping plates or other damping material can be inserted with a respective article into the individual pockets 4 or 5.

The pockets shown in FIGS. 1 and 2 are open both from the top and also from the ends thereof, that is to say charging or loading of the individual pockets can be effected from above as indicated by the arrow A or from the side as indicated by the arrow B.

FIG. 2 shows the same apparatus but with the pockets lifted up as shown by the directional arrow. In this case, in their upper region, the pockets can have a frame which extends therearound and on which they are suspended, but it is also possible for only the longitudinal frame members 3 of the frame together with the pockets to be suspended from the frame portions 2, without additional frame elements also being provided for suspending the pockets. It will be noted that the pockets themselves can in turn be suspended on movable transverse bars extending between the two oppositely disposed bars or longitudinal frame members 3. FIG. 2 shows both alternatives, namely frame members 3 which also still form the connection between the frame portions 2 when the pockets are lifted up and also the frame members 3 which are lifted up with the pockets. Thos two configurations can be implemented alternatively on one and the same apparatus, but also in combination with each other.

FIG. 3 shows in detail how the frame portions 3 are suspended on the frame portions 2. For that purpose, U-shaped holding clips 8 are mounted to the frame portions, more specifically the limb 9 of the U-shape is secured to the respective frame portion 2 and the limb 10 of the U-shape extends at a spacing from the limb 9 in parallel relationship therewith. In addition the limb of the U-shape in turn has a U-shaped recess 11 whose width approximately corresponds to the thickness of the bar 3. At its end the bar 3 has an end plate 12 which is engaged between the two limbs 9 and 10 of the U-shape, with the bar itself fitting into the U-shaped recess 11 in the inner limb 10. Not shown here are securing elements by means of which, if necessary, the bar 3 can be prevented from slipping out of the U-shaped recess 11.

After the pockets with the associated frame portions 3 have been lifted up, as shown by the directional arrow of FIG. 3, they are simply let down and put into the bottom box 1. The frame portions 2 which still remain and which are pivotably mounted to the ends of the bottom portion 1 are then folded in. This operation is shown in FIGS. 4 and 5, as shown by the directional arrow in FIG 4. That then affords a very compact, flat box whose outside dimensions and in particular whose height is so adapted to the apparatus that the collapsed pockets 4 or 5 with the frame portions 3 still thereon can be fitted flat into that box, in which case the two frame portions 2 can also be folded in, in the manner of a cover.

FIGS. 6 through 13 show an alternative embodiment with pockets which can be set up in a free-standing configuration. In FIG. 6 the apparatus is shown in the form of a cuboidal box which is closed therearound. In this case the upper cover is formed from two material webs 13 which are each mounted to the upper outer ends of the first and last pockets respectively of the corresponding group of pockets 14. The apparatus of FIG. 6 is shown once again in FIG. 7 in a condition in which the two material webs 13 are folded down. This view also shows a compartment division forming individual pockets, wherein the ends of those pockets are now closed by wall elements 15 which comprise a more or less stiff but nonetheless foldable material. The wall portions 15 are foldable generally in a concertina-like manner, more specifically along inwardly bending fold lines 16 and outwardly bending fold lines 17 which are respectively aligned with the transversely extending intermediate walls of the individual pockets. Foldability of those side wall portions 15 can be afforded for example by the side wall portions 15 consisting overall in a double-wall construction of a cloth or a similar material web, with the formation therein of pockets which extend over the entire height of that side wall and the width of which corresponds to the fold width. It is possible to then insert into those pockets for example plastic strips, wooden bars or the like which impart sufficient stiffness to the side walls while nonetheless making them foldable in a concertina-like manner.

The foldability of those pockets and their capability of standing up are particularly clearly shown in FIGS. 8 through 10. FIG. 8 shows the open pockets in a substantially pushed-together condition but in that condition they can still stand freely on the bottom plate 1. FIG. 9 shows an alternative form of this embodiment, which on the one hand in addition to the pockets themselves also has an outer frame to which the pockets can be fixed in the completely deployed condition so that they can retain for example the completely open condition shown in FIG. 7. Hooks, clips, transverse struts or other elements can be provided for that purpose, on the pockets, preferably on each of the first and last pockets, and on the frame portions, so that the pockets can be fixed in the desired position. In addition FIG. 9 also shows a further possible way of pulling together the open (and empty) pockets 14, more specifically by means of a strap 21 of which two strips extend parallel to the side walls 5 and preferably through loops arranged there, while the strap part 22 connecting those two longitudinal strip portions 21 extends transversely over the first and last of the pockets. That strap part 22 can in turn comprise a somewhat stiffer material or may have an inlay or the like comprising a stiff material. By pulling the straps tight, the pockets 14 are also pressed together very firmly and compactly to form a small unit.

FIG. 10 diagrammatically shows a side view of the pockets in the condition of having been substantially pressed together, while FIGS. 12 and 13 show how those pockets are possibly portable as an independent unit and can be put onto or into the bottom portion. Thereafter, as already described hereinbefore, the frame portions 2 and 3' are again folded in, while in this case there are actually four pivotable frame portions 2 and 3' which are pivotably mounted independently to the bottom portion 1.

FIG. 11 also shows a part of the lower corner regions of the individual pockets 14 with the dividing walls 18 and 19 between the individual pockets and the side wall portion 15 with a fold line 16. The two dividing walls 18 and 19 are also connected together by a bottom strip 20 whose width is such that it is somewhat greater than the width of the two side wall portions 15 which connect the dividing walls 18 and 19 together. That lower strip 20 however is intentionally not connected to the side wall portions 15 as on the one hand that is in any case not possible cleanly and without problems, but on the other hand also to permit dirt, dust and the like to be conveyed out through the opening by way of the bottom element.

It will be appreciated that the side portions of the frame shown in the Figures do not necessarily have to be such that they can be folded in or can be removed, but that even in the case of a fixed, non-collapsible frame or housing, the inner pockets or the inner compartment divisions can be collapsed together and selectively replaced (for example by other collapsible pockets) or can be put into the housing, in the collapsed condition.

What is claimed is:

1. Apparatus for storing and transporting piece goods comprising a bottom, a frame arranged on the bottom and a plurality of flexible pockets which can be unfolded and can be attached in an unfolded configuration within the frame and which pockets can be collapsed into a folded configuration and stored in a housing formed from the bottom and the frame, wherein the frame is moveably connected to the bottom so that the frame can be moved and stored with the collapsed pockets and the bottom so that neither the pockets nor the frame extend beyond a base area of the bottom, and wherein two pivotable frame portions are pivotably connected to two oppositely disposed ends of the bottom portion, said pivotable frame portions being securable in a vertically upwardly pivoted position, said pivotably frame portions being rigidly connectable by horizontal bearing members.

2. Apparatus according to claim 1 wherein at least some of the pockets are formed from interconnected material webs that when suspended from the frame in an unfolded configuration define a compartmentalized organization.

3. Apparatus according to claim 1 wherein frame portions can be connected together to form a rigid frame structure for holding the unfolded pockets and can be released from each other to permit at least some portions of the frame to be used in conjunction with the bottom to form the housing.

4. Apparatus according to claim 1 wherein the pockets are suspended on the horizontal bearing members.

5. Apparatus according to claim 1 wherein the unfolded pockets are open at their top and laterally.

6. Apparatus according to claim 1 wherein the pockets have sufficiently stiff foldable side portions to permit the pockets to be set up in a free-standing position.

7. Apparatus according to claim 6 wherein the pockets have a lateral concertina-like folding configuration, wherein a plurality of pockets are connected together in such a way that the concertina-like folding continues continuously from one pocket to the next following pocket.

8. Apparatus according to claim 6 wherein connecting sites are provided on at least one of the bottom or frame to which the pockets may be connected to form a group and can be held in an unfolded condition.

9. Apparatus according to claim 1 wherein the bottom is in the form of an upwardly open box whose internal width and length dimensions correspond to the outside dimensions of the open pockets in the lengthwise and widthwise directions.

10. Apparatus according to claim 9 wherein the height of frame portions mounted to longitudinal sides of the box is less than the internal widthwise dimension of the box and the height of end frame portions is less than internal lengthwise dimension of the box.

11. Apparatus according to claim 1 wherein a strap is provided which embraces all of the pockets on an outside thereof on at least three sides and which is passed through loops along two end surfaces of the pockets.

12. Apparatus according to claim 11 wherein the strap extends transversely over end pockets, which strap is reinforced by a stiff element.

13. Apparatus according to claim 1 wherein a flexible material web is provided at the upper edge of an end pocket, said material web having an overall length sufficient to cover open top sides of all pockets in the unfolded configuration.

14. Apparatus according to claim 13 wherein the material web can be closed with a touch-and-close fastener.

15. The apparatus of claim 1 where the pockets are suspended from the horizontal bearing members.

16. The apparatus of claim 1 where the pockets are arranged to unfold vertically for erection and suspension from the horizontal bearing members.

17. The apparatus of claim 1 where the pockets are arranged to be erected in a folded configuration and to be unfolded horizontally.

* * * * *